US009624664B2

(12) United States Patent
Judd

(10) Patent No.: US 9,624,664 B2
(45) Date of Patent: Apr. 18, 2017

(54) POPCORN CEILING PATCH

(71) Applicant: Jennifer Judd, East Hampton, CT (US)

(72) Inventor: Jennifer Judd, East Hampton, CT (US)

( * ) Notice: Subject to any disclaimer, the term of this patent is extended or adjusted under 35 U.S.C. 154(b) by 72 days.

(21) Appl. No.: 14/449,681

(22) Filed: Aug. 1, 2014

(65) Prior Publication Data

US 2015/0197936 A1 Jul. 16, 2015

Related U.S. Application Data

(60) Provisional application No. 61/928,248, filed on Jan. 16, 2014.

(51) Int. Cl.
*E04B 9/00* (2006.01)
*E04G 23/02* (2006.01)
*E04B 1/99* (2006.01)

(52) U.S. Cl.
CPC ..... *E04B 9/001* (2013.01); *E04G 23/0296* (2013.01); *E04B 1/994* (2013.01)

(58) Field of Classification Search
CPC ..... E04B 9/001; E04G 23/0296
USPC ..... 52/514; 156/94
See application file for complete search history.

(56) References Cited

U.S. PATENT DOCUMENTS 4,135,017 A 1/1979 Hoffmann, Sr.
4,335,554 A 6/1982 Nicholson
4,358,495 A 11/1982 Parker
4,370,842 A 2/1983 Martin et al.
4,632,790 A 12/1986 Bernard
4,776,906 A 10/1988 Bernard
4,916,880 A 4/1990 Westerman, Jr.
4,945,700 A 8/1990 Powell
4,959,251 A 9/1990 Owens et al.
4,978,404 A 12/1990 Westerman, Jr.
5,018,331 A 5/1991 Forzano
5,023,987 A 6/1991 Wuepper et al.
5,033,949 A 7/1991 Jewett
5,075,149 A 12/1991 Owens et al.
5,269,861 A 12/1993 Gilbreath
5,435,866 A 7/1995 Puppin
5,556,688 A 9/1996 Cox
5,569,346 A 10/1996 Marshall
5,619,836 A 4/1997 Rouch et al.
5,620,768 A 4/1997 Hoffmann, Sr.
5,629,065 A 5/1997 Schinabeck
5,687,528 A 11/1997 Rouch
5,778,624 A 7/1998 Russell
5,820,958 A 10/1998 Swallow
5,897,725 A 4/1999 Werner
5,925,204 A 7/1999 Hoffmann, Sr.
6,000,583 A * 12/1999 Stern ..... B05B 1/02 222/402.1
6,044,613 A 4/2000 Crafts et al.
6,071,833 A 6/2000 D'Alisa et al.
6,088,986 A 7/2000 DiGate
6,162,525 A 12/2000 Amy
6,209,277 B1 4/2001 DiGate
6,231,949 B1 5/2001 Hoffmann, Sr.
6,247,283 B1 6/2001 Slabaugh et al.
(Continued)

*Primary Examiner* — Jeremy Luks
(74) *Attorney, Agent, or Firm* — McCormick, Paulding & Huber LLP

(57) ABSTRACT

A popcorn patch article has a flexible substrate with a sticky surface and a facing surface opposite the sticky surface, and an acoustic texture captured on the facing surface of the substrate.

11 Claims, 2 Drawing Sheets

(56) References Cited

U.S. PATENT DOCUMENTS 6,347,496 B1 2/2002 Pinkins
6,378,263 B1 4/2002 Sobers
6,508,040 B2 1/2003 Nelson
6,607,621 B1 * 8/2003 Swanson ..... E04G 23/0203 156/71
6,627,292 B1 9/2003 Hoffmann, Sr.
6,629,392 B1 10/2003 Harrel et al.
6,641,864 B2 * 11/2003 Woods ..... C09K 3/30 427/140
6,918,219 B1 7/2005 Olson
7,107,924 B2 9/2006 Schroeder
7,257,931 B2 8/2007 Jones
7,303,802 B1 12/2007 Brower et al.
7,316,835 B1 * 1/2008 Swanson ..... C09J 7/0296 156/71
7,380,382 B2 6/2008 Hansen
7,470,339 B2 12/2008 Hoffmann, Sr. et al.
7,938,923 B2 5/2011 Hood
7,971,405 B2 7/2011 Hansen
7,981,229 B2 7/2011 Hood et al.
8,021,505 B2 9/2011 Lewis
8,281,538 B2 10/2012 Waters
8,328,970 B2 12/2012 Lewis
8,349,110 B1 1/2013 Kochis
8,381,474 B2 2/2013 Lewis
8,511,029 B2 8/2013 Hansel
2002/0059767 A1 5/2002 Nelson
2002/0083679 A1 7/2002 Hanner
2002/0102381 A1 8/2002 McClurg
2005/0086889 A1 4/2005 Shock
2005/0144876 A1 7/2005 Jones
2005/0204672 A1 9/2005 Hansen
2006/0010817 A1 1/2006 Shull
2006/0059829 A1 3/2006 Flynn
2006/0096220 A1 5/2006 Greer, Jr. et al.
2006/0101765 A1 5/2006 Bailey
2007/0087151 A1 4/2007 Hoffmann, Sr. et al.
2008/0115443 A1 5/2008 Hathaway
2008/0116087 A1 5/2008 Hathaway
2008/0163975 A1 7/2008 Hoffmann et al.
2008/0229694 A1 9/2008 Ising
2008/0314510 A1 12/2008 Hood
2009/0288755 A1 11/2009 Lewis
2011/0239577 A1 10/2011 Hansen
2011/0265935 A1 11/2011 Hood
2011/0265936 A1 11/2011 Hood
2011/0277412 A1 11/2011 Karam et al.
2011/0277914 A1 11/2011 Hood
2011/0283645 A1 11/2011 Waters
2012/0031033 A1 2/2012 Lewis
2012/0060439 A1 3/2012 Clarke et al.
2012/0152439 A1 6/2012 Hansen
2013/0112340 A1 5/2013 Tait et al.
2013/0125493 A1 5/2013 Raheel
2016/0009055 A1 * 1/2016 Spadaro ..... B32B 7/06 428/41.8

* cited by examiner

POPCORN CEILING PATCH

CROSS REFERENCE TO RELATED APPLICATIONS

This application is a non-provisional claiming the benefit under 35 USC §119(e) of U.S. App. 61/928,248 "Popcorn Ceiling Patch," filed 16 Jan. 2014.

BACKGROUND

Technical Field

Embodiments of the invention relate to home repairs, more particularly, to repair of ceilings.

Discussion of Related Art

Many homes are built with ceilings made either of gypsum board, covered with a thin layer of "mud" (plaster) or entirely of plaster over lath. Often, gypsum board ceilings have been finished with an acoustic texture material commonly known as "popcorn." This type of ceiling was particularly popular during the 1980s and has continued to be used in new construction.

Although any sort of ceiling can suffer damage from a variety of causes (bumps and scratches by moving objects, water leaks, and so forth), popcorn ceilings can be particularly challenging to repair. Even if the damaged structure (gypsum board and plaster) can merely be patched instead of being completely replaced, the acoustic texture material must be repaired in a way that matches to surrounding surface. Professionals in the field agree that achieving a visual match of popcorn texture is a time consuming and highly frustrating endeavor.

Current methods for fixing a popcorn ceiling include: removal of all popcorn on entire ceiling where the damage is (messy, costly, time consuming); spraying popcorn texture from a can onto the damaged area (e.g., as disclosed by U.S. Pub. 2013/0112340); rolling/brushing paint and popcorn texture onto the damaged area; or spraying paint and popcorn texture from a popcorn sprayer apparatus onto the damaged area.

Spraying of popcorn requires blocking off the spray area with sheets of plastic by dropping the plastic from the ceiling to floor (held by tape or tacks), as well as on the floor underneath. Over spray is significant and will get on the surrounding areas if not properly blocked. Despite best efforts of skilled workers, sprayed texture seldom exactly matches the existing surrounding popcorn texture, so that home owners seldom are pleased with the results. Similarly, brushed or rolled texture also very seldom matches extant texture to the point of satisfaction.

A more exotic technique for matching popcorn texture is to mold and cast an exact copy of adjacent popcorn texture (e.g., as disclosed by U.S. Pat. No. 8,349,110).

BRIEF DESCRIPTION

According to embodiments of the invention, a popcorn patch article has a flexible substrate with a sticky surface and a facing surface opposite the sticky surface, and an acoustic texture captured on the facing surface of the substrate.

According to aspects of the invention, a popcorn patch article is made by applying an acoustic texture to a facing surface of a flexible substrate having a sticky surface opposite the facing surface; and applying a cover coating over the acoustic texture.

According to aspects of the invention, a damaged acoustic ceiling is repaired by removing a backing paper from a sticky surface of a flexible substrate that has an acoustic texture captured on a surface opposite the sticky surface, and applying the sticky surface of the flexible substrate to the acoustic ceiling to cover the damaged area with the acoustic texture facing downward

DRAWINGS

DETAILED DESCRIPTION

A popcorn or acoustic ceiling patch ("Popcorn Patch"), according to an embodiment of the invention, is a patch that has a simulated popcorn texture with a 'peel and stick' backing. It is a flexible and paintable texture that is easily applied to the damaged area of the ceiling. It is available in at least three different popcorn textures ranging from small popcorn texture to large. It is available in various sizes to accommodate damaged areas from small to large, for example:

a) 4"×4" Patch b) 6"×6" Patch c) 6"×6' Roll.

The large roll can be cut to size and used for many sized areas such as narrow, long strips along the ceiling where the wall and ceiling meet, or larger damaged ceiling areas than what the smaller Popcorn Patches would be used for. The large roll can be used in its entirety, similar to wallpaper, in order to cover large rectangular ceiling areas. Indeed, the large roll might be used for original installation of popcorn ceiling in new construction.

Figure 1:
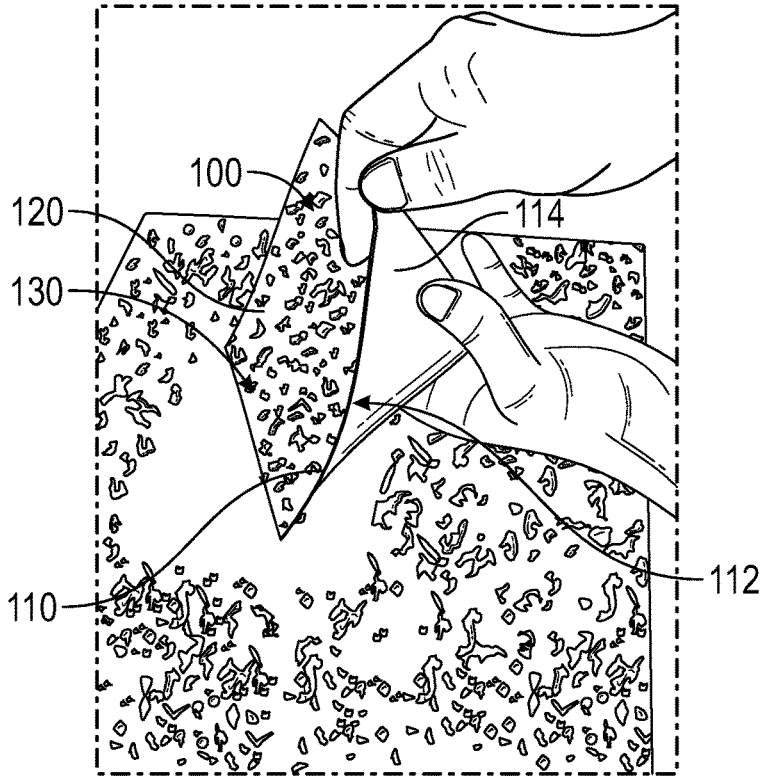
FIG. 1 shows a popcorn patch article according to a first embodiment of the invention.

In an exemplary embodiment, the following materials are used to make a popcorn patch article 100 that has a pre-sprayed popcorn texture, as shown in FIG. 1:

Flexible substrate 110 with a sticky surface 112 and a backing layer 114, e.g., "Controltac Graphic Marketing System" brand label material as manufactured by 3M, or any sticky-backed cellulose, cloth, polymer, or metal substrate having structural properties suitable for use in the forms above described. Although the "Controltac" brand label material has an adhesive applied as its sticky surface, sticky surfaces equally may be mechanically formed—e.g., as microfibers, similar to the hairs of a gecko's foot; or as hooked fibers, similar to those of hook-and-loop fasteners; or as spines or prickles, with or without barbs, e.g., similar to those of thistles or cacti.

Popcorn texture 120 (e.g., Homax brand, Zinnser brand, or any other popcorn texture available in stores or equivalent substance), which is sprayed onto a facing surface 116 of the flexible substrate 110. Although the exemplary "Controltac Graphic Marketing System" has a non-sticky facing surface and is convenient to handle, it may be equally acceptable to use a substrate 110 that has two sticky surfaces, e.g., in the nature of double-sided tape.

Flexible cover coating 130 (e.g., Rust-oleum brand Leak-Seal Flexible Rubber Coating, or any similar flexible and water-resistant coating), which is applied over the popcorn texture 120 to make it pliable for installation and also to ensure that the popcorn texture will not crumble/flake off during storage and/or shipping or after installation. In case the flexible substrate 110 might have two sticky surfaces, it will be particularly desirable to ensure that the popcorn texture 120, and/or the flexible cover coating 130, completely cover the sticky surface that otherwise might be exposed to accumulate dust as installed. Additionally, it may be desirable to apply the acoustic texture to leave portions of the facing surface exposed, and to apply the flexible cover coating to cover both the acoustic texture and the exposed portions of the facing surface, thereby capturing the acoustic texture to the facing surface. In case the acoustic ceiling has been water-damaged, better results may be obtained by priming the scraped ceiling prior to installation.

Figure 2:
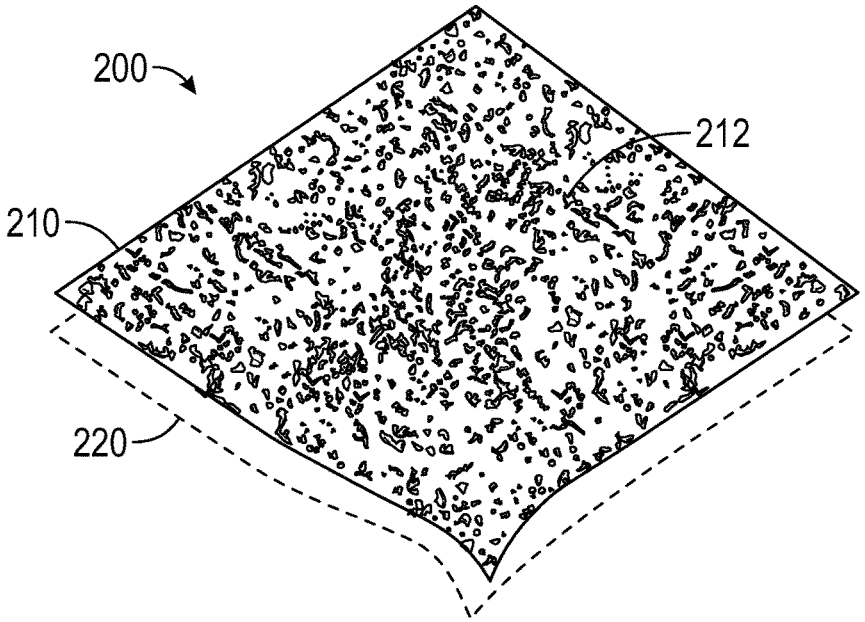
FIG. 2 shows a popcorn patch article according to a second embodiment of the invention.

According to other embodiments of the invention, as shown in FIG. 2, a popcorn patch article 200 with integrally molded popcorn texture may be formed (e.g. by injection molding, blow molding, or the like process) as a single molded polymer sheet 210 having an adhesive layer 220. In such embodiments, a popcorn texture 212 is integrally formed in the polymer sheet 210, while a backing layer 114 is provided as for the popcorn patch article 100.

Figure 3:
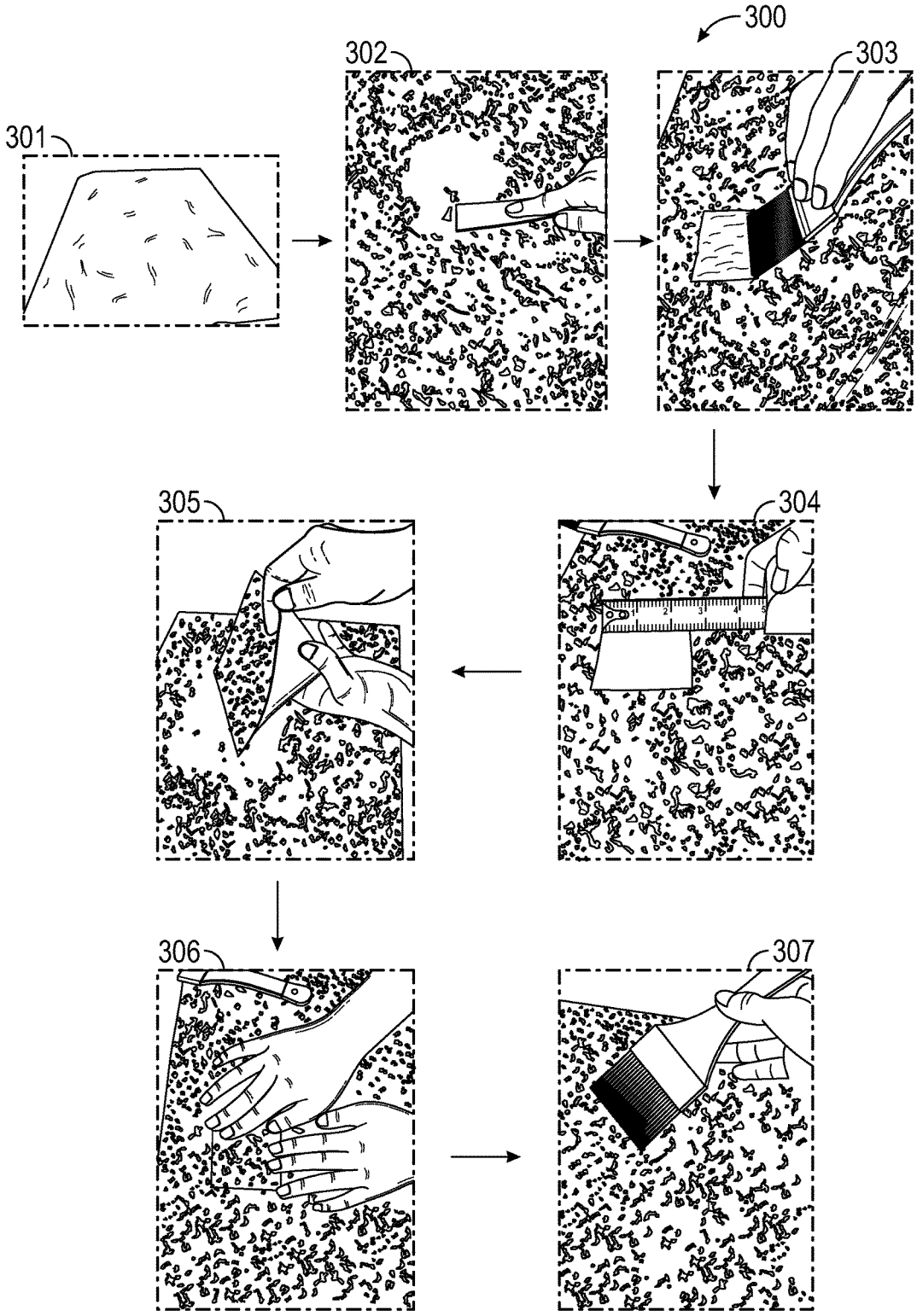
FIG. 3 shows steps of a method for repairing a damaged acoustic ceiling, using a popcorn patch article according to the invention.

According to an aspect of the invention, the Popcorn Patch may be applied by a method 300 that comprises the following steps (as shown in FIG. 3):

301. Lay a drop cloth and/or plastic on the floor beneath the damaged area.

302. Remove the damaged popcorn by scraping (e.g., with a putty knife).

303. Optionally, brush away remaining debris.

304. Measure the diameter of the damaged area.

305. Peel backing paper off of the Popcorn Patch

306. Apply sticky side of the Popcorn Patch to the ceiling

307. Paint over flexible popcorn texture coating.

Thus, in embodiments, either the damaged acoustic texture may be removed to fit the size of the available popcorn patch article; or the popcorn patch may be cut to the size of the area with removed acoustic texture. Optionally, small amounts of brush-on popcorn texture can be added to cover edges of the Popcorn Patch. Optionally, edges of the Popcorn Patch may be cut to irregular shape so as to obscure the seam between the Popcorn Patch and the original ceiling texture.

Although exemplary embodiments of the invention have been described with reference to attached drawings, those skilled in the art will apprehend various changes in form and detail consistent with the scope of the invention as defined by the appended claims.

What is claimed is:

1. A popcorn patch article comprising:

a flexible substrate with a sticky surface and a facing surface opposite the sticky surface;

an acoustic texture applied to the facing surface of the substrate; and a flexible cover coating applied over the combined acoustic texture and flexible substrate for capturing the acoustic texture on the facing surface of the substrate.

2. The article as claimed in claim 1, wherein the facing surface is a sticky surface, and at least one of the acoustic texture or the cover coating completely covers the facing surface.

3. The article as claimed in claim 1, wherein the acoustic texture is captured on the facing surface of the flexible substrate by being integrally formed in the flexible substrate.

4. The article as claimed in claim 3, wherein the sticky surface comprises an adhesive layer applied onto the flexible substrate.

5. The article as claimed in claim 3, wherein the sticky surface comprises microfibers integrally formed in the flexible substrate.

6. The article as claimed in claim 3, wherein the sticky surface comprises spines integrally formed in the flexible substrate.

7. A method for making a popcorn patch article, comprising the steps of:

(a) applying an acoustic texture to a facing surface of a flexible substrate having a sticky surface opposite the facing surface; and then (b) applying a flexible cover coating over the acoustic texture, wherein the acoustic texture is applied to leave portions of the facing surface exposed, and the flexible cover coating is applied to cover both the acoustic texture and the exposed portions of the facing surface, thereby capturing the acoustic texture to the facing surface.

8. The article as claimed in claim 1, wherein the flexible cover coating is a flexible water-resistant rubber coating applied to ensure that the acoustic texture will not crumble during shipping, handling and installation.

9. The article as claimed in claim 1, wherein the flexible cover coating is a pre-formed coating.

10. A popcorn patch article for use on ceilings comprising:

a flexible substrate with a sticky surface and a facing surface opposite the sticky surface;

an acoustic texture applied to the facing surface of the substrate; and a preformed flexible cover coating applied over the combined acoustic texture and flexible substrate for securing the acoustic texture on the facing surface of the substrate, wherein the flexible cover coating is a leak-seal flexible rubber coating, and wherein the flexible cover coating and acoustic texture are applied to the facing surface prior to the application of the patch article.

11. The article as claimed in claim 10, wherein the acoustic texture is applied to the facing surface of the flexible substrate by being integrally formed in the flexible substrate.

* * * * *